United States Patent [19]

Sanchez

[11] Patent Number: 4,789,262

[45] Date of Patent: Dec. 6, 1988

[54] SOAP HOLDING CLEANING PAD

[76] Inventor: Theolinde Sanchez, 1504 Idaho Ave., Orlando, Fla. 32809

[21] Appl. No.: 499,837

[22] Filed: Jun. 1, 1983

[51] Int. Cl.[4] ..... A47K 7/02

[52] U.S. Cl. ..... 401/201

[58] Field of Search ..... 401/201; 128/65; 132/1 R, 79 A, 79 B, DIG. 3

[56] References Cited

U.S. PATENT DOCUMENTS

| | | | |
|---|---|---|---|
| 1,404,401 | 1/1922 | Novick | 401/201 |
| 2,829,392 | 4/1958 | Dupuy | 401/201 |
| 2,899,780 | 8/1959 | Bottino | 401/201 |
| 2,958,885 | 11/1960 | Donney | 401/201 |
| 3,860,349 | 1/1975 | Scott | 401/201 |
| 3,977,796 | 8/1976 | Gillespie et al. | 401/201 |
| 4,187,575 | 2/1980 | Collins | 128/65 |
| 4,228,834 | 10/1980 | Desnick | 401/201 |

*Primary Examiner*—Gene Mancene
*Assistant Examiner*—Cary E. Stone
*Attorney, Agent, or Firm*—William M. Hobby, III

[57] ABSTRACT

A soap holding cleaning pad apparatus has a nylon cloth sack which has a nylon mesh forming a portion of a sack wall. A sponge material forms a cleaning surface and is mounted over the nylon mesh and a soap or detergent is located in the nylon cloth sack to provide a rapidly drying soap holder which controllably releases the soap. The sponge material is made of a luffa plant fiber sponge and the sack has a cord handle and an opening sealed with a hook and loop material.

1 Claim, 1 Drawing Sheet

SOAP HOLDING CLEANING PAD

BACKGROUND OF THE INVENTION

The present invention relates to soap holding cleaning pads or sacks in which soap is held in a manner to be controllably released and which dries rapidly to prevent the growth of mildew.

In the past, it has been common to provide a wide variety of cleaning pads and sponges and it has been suggested in some of these to hold soap or cleansing material inside the sponge or cleaning pad. Thus, when a person washes with the sponge or washes dishes or other objects with the cleaning pad, the soap is released through the pad or the sponge. This allows a sponge or cleaning pad to be utilized without separately applying the soap to the object being cleaned. This type of cleaning pad has several problems. Many release the soap too rapidly or too slowly and sponges typically hold the soap dispersed in the sponge. Most of these devices have the soap dispensed therethrough during drying and are slow in drying, which results in the cleaning pads becoming rapidly mildewed. Typical prior art in this field in U.S. Pat. No. 4,159,883 to Mizell for a cleaning pad which has a cleaning agent therein and a tufted textile fabric like a terry cloth.

To overcome the disadvantages of the prior art, the present invention has a rapidly drying soap or detergent sack with a controlled release of the soap through a sponge or cleaning pad material. The sponge provides a desirable cleaning action with the proper controlled release of the soap from the sack. In addition, the materials will rapidly dry when hung by a cord handle without leaving messy soap dishes and without mildewing.

SUMMARY OF THE INVENTION

A soap holding cleaning pad apparatus is provided which has a nylon cloth sack having a nylon mesh portion formed in the wall thereof. A cleaning pad material is fixedly attached directly over the nylon mesh to the side of the nylon cloth sack. The cleaning material is a luffa plant fiber sponge or cleaning pad. The nylon sack has a closeable opening having hook and loop material mounted thereinside for sealing a cleansing material, such as soap or detergent, in the sack. The cord handle is attached to the sack to allow the soap holding cleaning pad to be used in a shower or bathtub and hung up to rapidly dry. The materials allow rapid drying without mildew, as well as a controlled release of the soap and a desirable cleaning sponge surface.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
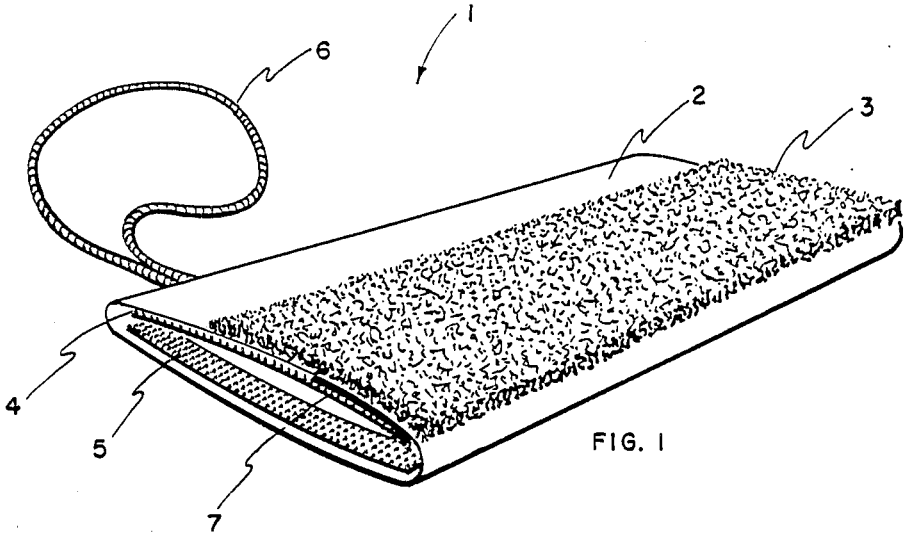
FIG. 1 is a perspective view of a soap holding cleaning pad in accordance with the present invention.
Figure 2:
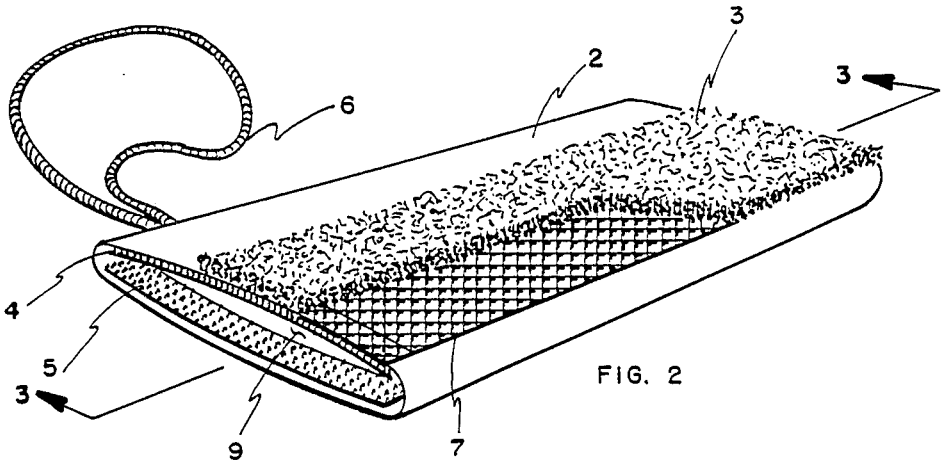
FIG. 2 is a cutaway perspective of the soap holding cleaning pad of FIG. 1 having a portion of the sponge material removed.

Referring to the drawings, a soap holding cleaning pad 1 has a nylon cloth sack 2 made of a thin nylon cloth and having a cleaning pad or sponge material 3 thereon mounted directly over a nylon mesh 7 formed directly in the nylon cloth sack 2. The wide nylon mesh 7 allows the free movement of liquid and soap through the walls of the sack 2. The sack 2 has an opening 9 having both sides of hook and loop material 4 and 5 placed on each side of the opening 9 to provide a closure for the sack which can readily be opened to replace the soap, if desired. A cord handle 6 is sewn onto the edge of the nylon cloth sack 2 for allowing the soap holding cleaning pad 1 to be hung in a bathroom for rapid drying.

Figure 3:
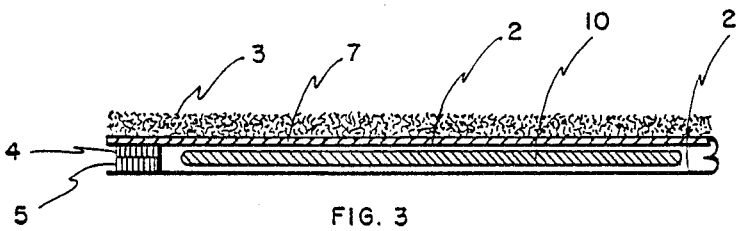
FIG. 3 is a sectional view taken on the line 3—3 of FIG. 2.

The nylon sack 2 has a small bar of soap 10 placed therein, as shown in FIG. 3. The term "soap" is used in a generic sense to include detergents and other cleaning materials that are desolved during use of the cleaning pad.

The present invention is especially designed for rapid drying as well as controlled soap dispensing with a specially skin cleaning sponge-like material 3. The thin nylon material in the sack 2, as well as the nylon mesh 7 dry rapidly while controlling the release of the soap. The soap is rapidly dispensed through the nylon mesh 7 into the sponge-like material 3 and is released controllably through the sponge-like material. The sponge-like material 3 is a luffa plant fiber material, which is commonly used in some parts of the world in cleaning and is made from the luffa plant which is similar to a gourd and which is dried, has the skin and seeds removed, and the fibers washed and dried for use as a cleaning sponge which is not only sufficiently soft for use on the skin, but dries rapidly and releases the soap at the desired predetermined rate. The soap 10 can be replaced at any time desired and the bag is especially long lasting because it is rapidly dried when hung by the cord 6 resisting mildew and growth of other micro-organisms.

The present invention advantageously uses materials which are put together in a combination which produces a desirable and long lasting soap holding cleaning pad. The assembly can be sewn together, such as with a sewing machine, or can be attached by other methods such as adhesive or welding, as desired. The present invention, however, is not to be construed as limited to the form shown which is to be considered illustrative rather than restrictive.

I claim:

1. A soap holding cleaning pad comprising:

a nylon cloth sack having an opening therein, said nylon cloth sack having a hook and loop material mounted along each inside edge thereof to allow said opening in said nylon cloth sack to be closed or opened for removing or holding a material therein;

a cord handle attached to said nylon cloth sack;

a nylon mesh formed into a portion of said nylon sack;

a luffa plant fiber material forming a cleaning surface mounted over said nylon mesh; and a bar of soap located in said nylon cloth sack, whereby a rapidly drying soap holding cleaning pad controllably releases soap.

* * * * *